US007161105B2

(12) United States Patent
Sabisch

(10) Patent No.: US 7,161,105 B2
(45) Date of Patent: Jan. 9, 2007

(54) ELECTRICAL SWITCHING DEVICE

(75) Inventor: Willy Sabisch, Kuemmersbruck (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/196,408

(22) Filed: Aug. 4, 2005

(65) Prior Publication Data

US 2006/0060456 A1 Mar. 23, 2006

(30) Foreign Application Priority Data

Aug. 5, 2004 (DE) ..... 10 2004 038 112

(51) Int. Cl.
*H01H 5/00* (2006.01)

(52) U.S. Cl. ..... 200/400; 200/410

(58) Field of Classification Search ..... 200/400–402, 200/410

See application file for complete search history.

(56) References Cited

U.S. PATENT DOCUMENTS 3,207,879 A * 9/1965 Goodwin, Jr. ..... 200/400
4,245,140 A * 1/1981 Jencks et al. ..... 200/400
4,301,434 A * 11/1981 Castonguay ..... 335/20
4,315,114 A * 2/1982 Monti, Jr. ..... 200/5 A
4,611,187 A 9/1986 Banfi
5,199,553 A * 4/1993 Shinohara et al. ..... 200/265
5,293,016 A * 3/1994 Nar ..... 200/401
5,302,788 A * 4/1994 Link et al. ..... 200/401
5,319,169 A * 6/1994 Link et al. ..... 200/401
5,481,074 A * 1/1996 English ..... 200/5 A
5,534,674 A 7/1996 Steffens
5,634,554 A * 6/1997 Dimarco et al. ..... 200/401
5,927,484 A * 7/1999 Malingowski et al. ..... 200/401
5,973,280 A * 10/1999 Gula et al. ..... 200/339
7,009,129 B1 * 3/2006 Vierling ..... 200/400

FOREIGN PATENT DOCUMENTS

DE 71 31 470 U 11/1971
DE 43 37 344 A1 5/1995

* cited by examiner

*Primary Examiner*—Michael Friedhofer
*Assistant Examiner*—Lisa Klaus
(74) *Attorney, Agent, or Firm*—Harness, Dickey & Pierce, P.L.C.

(57) ABSTRACT

An electrical switching device, in particular a circuit breaker, is disclosed. In order to shorten the opening times of a switching device such as this, a snap-action system is used. The system interacts with the moving contact piece, of an electrical switching device having a switching shaft and having a moving contact piece which can be operated by the switching shaft, such that the moving contact piece is automatically moved to a switched-off position after opening of the contact by electrodynamic forces in the event of a short circuit or the like. The contact load on the moving contact piece decreases as the opening increases. This may result in better short-circuit current limiting. The overall production costs may be considerably reduced.

6 Claims, 14 Drawing Sheets

ELECTRICAL SWITCHING DEVICE

The present application hereby claims priority under 35 U.S.C. §119 on German patent application number DE 10 2004 038 112.7 filed Aug. 5, 2004, the entire contents of which is hereby incorporated herein by reference.

FIELD

The invention generally relates to an electrical switching device, in particular to a circuit breaker.

BACKGROUND

In the event of short circuits, the thermal and electrodynamic load on electrical systems should be kept as low as possible. In particular, the magnitude of the short-circuit current should be limited.

When a short circuit is disconnected by a circuit breaker, this is achieved by an arc voltage very rapidly opposing the driving voltage. This is achieved by rapid opening of the contact point in the circuit breaker, so that the arc is guided quickly and is driven into the quenching plates, where it is split into a number of arc elements. This arc voltage counteracts the driving voltage and thus limits the short-circuit current. The level of limiting depends on the time which is required to produce the arc voltage. This is in turn dependent on the contact opening time.

SUMMARY

An object of at least one embodiment of the invention is to shorten the contact opening times. This object may be achieved by an electrical switching device.

In the case of an electrical switching device having a switching shaft and having a moving contact piece which can be operated by the switching shaft, at least one embodiment of the invention provides for the use of a snap-action system which interacts with the moving contact piece. As such, the moving contact piece is automatically moved to a switched-off position after opening of the contact by electrodynamic forces in the event of a short circuit or the like, with the contact load on the moving contact piece decreasing as the opening increases.

Accordingly, at least one embodiment of the invention relates to a switching device which has a falling contact load characteristic when plotted against the opening distance. Thus the load decreases as the opening of the contacts increases, allowing the contacts to open more quickly. The shorter opening time in turn indicates that the arc voltage counteracts the driving voltage more quickly. This results in better short-circuit current limiting (low $I^2t$ value). The lower $I^2t$ value reduces the load on the overall system. Furthermore, the circuit breakers can be designed to be smaller. Less material is required for production, and the overall production costs are considerably reduced.

Advantageous embodiments of the invention are specified, according to which it is advantageous that the snap-action system may be mounted on the moving contact piece with a dead-point joint being formed, and/or the moving contact piece may be mounted on the switching shaft with a dead-point joint being formed. The arrangement of the two dead-point joints may aid or even ensure a falling contact load line when plotted against the opening distance, with this line rising negatively after a dead-point.

It is also advantageous for the dead-point joints to be arranged such that the line of action of a spring element which acts on the snap-action system never passes through the two rubbing circles of the dead-point joints at the same time. This ensures a continuous, low-friction contact force.

BRIEF DESCRIPTION OF THE DRAWINGS

The invention will be explained in more detail in the following text using an example embodiment, which is described with the aid of the drawings, in which.

DETAILED DESCRIPTION OF THE EXAMPLE EMBODIMENTS

Figure 1:
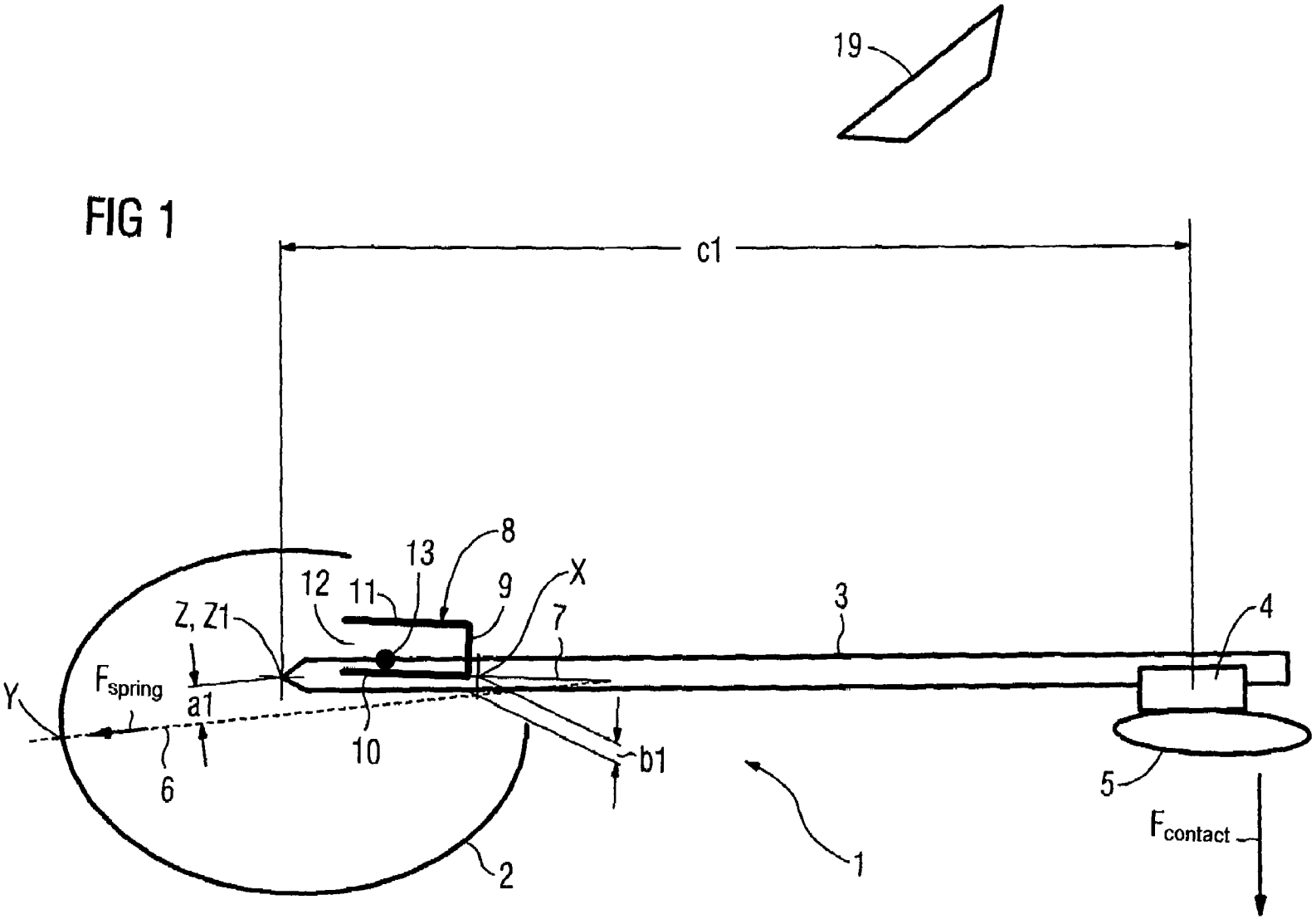
FIGS. 1–13 show schematic illustrations of a switching device according to at least one embodiment of the invention in various switching positions.

FIG. 1 shows a simplified schematic illustration of a switching device 1 in its switched-on position. The switching device 1 has a switching shaft 2 which is guided in a bearing bush (not shown) in the enclosure of the switching device 1, and is used to operate the contact arrangements of the switching device 1. In the present example, the switching device 1 is a three-pole electrical switching device 1, with one moving contact piece 3 being associated with each phase. The moving contact piece 3 of a single phase is shown here, for illustration purposes.

The switching shaft 2 is moved by a switching mechanism (not shown) in order to carry out the switching process. For this purpose, the switching shaft 2 is mounted at a rotation point Z1. Since the movement of the switching shaft 2 together with the associated switching mechanism would be too slow in the event of a short circuit to achieve rapid contact opening, the individual moving contact pieces 3 are mounted with their switching levers in the switching shaft 2 at the point Z. The rotation points Z and Z1 are coincident with one another. The rotation point Z is in this case in the form of a dead-point joint. Each of the three contact pieces 3 is mounted in the switching shaft 2 such that it can move individually. In the event of a short circuit, contact opening of each switching contact 3 is possible independently of the other phases, since, in the event of a short circuit, the three contact pieces are not loaded uniformly, by virtue of the phase shift (90° in the case of alternating current).

In the switched-on position, as illustrated in FIG. 1, the contact face 4, which is preferably manufactured from a noble metal, for example silver, of the moving contact piece 3 presses against the fixed contact piece 5 with a force which produces a spring force $F_{spring}$ on the force line of action 6. This force line of action 6 is produced by a spring element (not shown) which is used as a contact load spring and is in the form of a rotation or tension spring. The spring element is attached, for example by being hooked in, at one end at the point Y on the switching shaft 2 and at the other end on the extended limb 7 of a claw 8.

The claw 8 is essentially U-shaped and is mounted in the area of its U-base 9 at a point X on the moving contact piece 3 such that it can rotate. However, it is also possible to use a different form of snap-action system rather than the claw 8, for example in the form of a toothed wheel. The rotation point X of the claw 8 is in the form of a dead-point joint. The attachment is in this case preferably designed in such a way that a bolt which is fitted to the contact piece 3 is inserted in a retaining opening in the claw 8 (not shown).

In this case, the opening 12 (which is formed by the two U-limbs 10, 11) of the claw 8 points in the direction of the bearing point Z. In the switched-on position, the claw 8 is supported by the inner face of its inner U-limb 10 on a supporting element 13, which is part of the switching shaft 2 and is in the form of a projection or pin. The extension of the inner U-limb 10 beyond the U-base 9 in the direction of the contact face 4 forms the extended limb 7, to whose end the spring element is fixed. If the pairing formed by the claw and supporting element is in the form of an involute tooth system, the system has even less friction.

In the position illustrated in FIG. 1, the switching shaft 2 is held in position by the switching mechanism. The spring element pulls on the claw 8, in the sense of rotating it clockwise, via a lever arm b1 along the force line of action 6. The lever arm b1 in this case corresponds to the distance between the rotation point X of the claw 8 and the force line of action 6. A torque thus acts at the rotation point Z on the moving contact piece 3 in the contact position, and produces a contact force $F_{contact}$, which acts on the fixed contact piece 5, via the lever arm c1, with a1 being the distance between the rotation point Z of the moving contact piece 3 and the force line of action 6. The claw 8 is locked in a static fixed state in this position.

Figure 2:
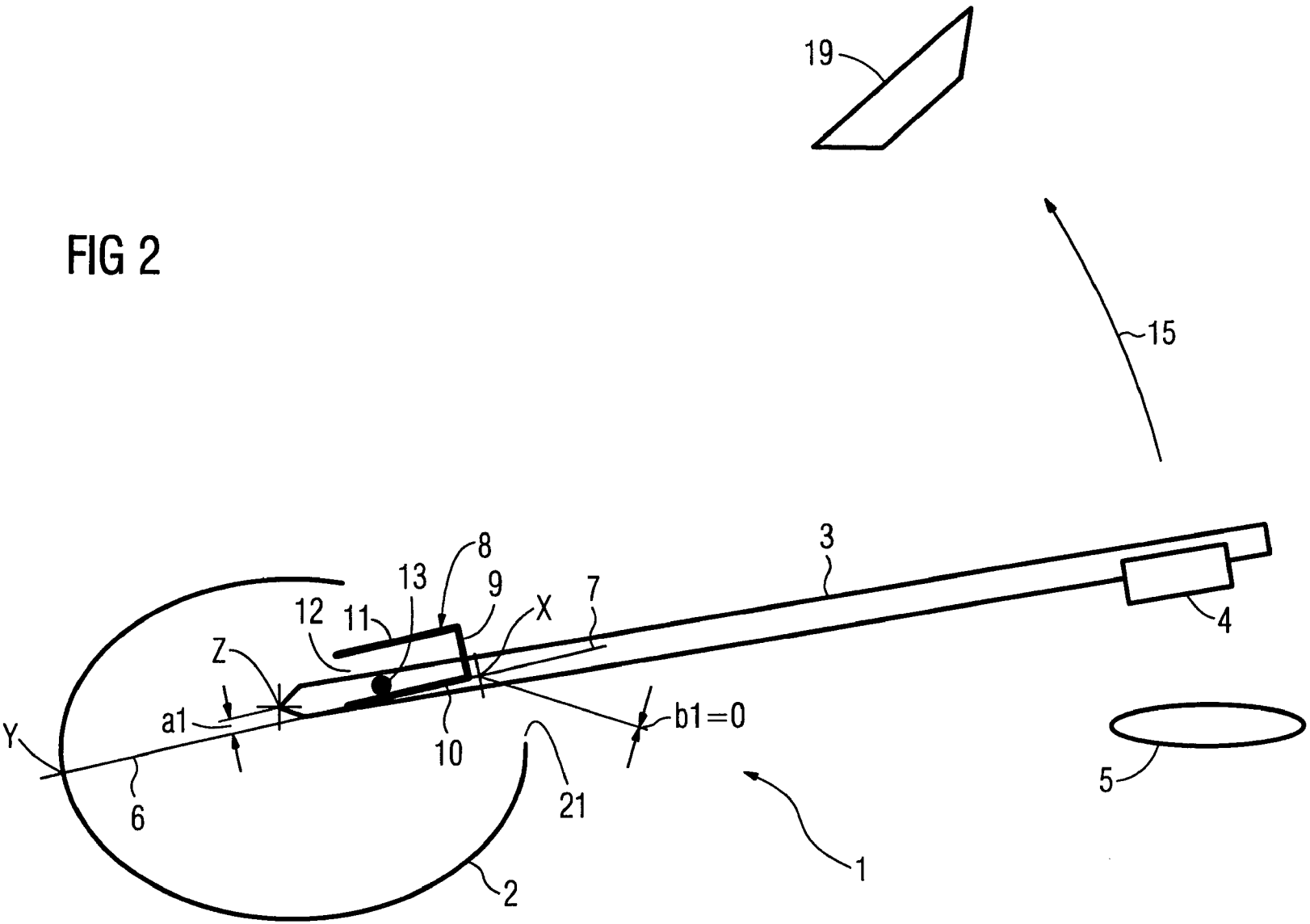

In FIG. 2, the moving contact piece has been moved away from the fixed contact piece 5 by electrodynamic forces following a short circuit at the contact point. This movement changes the lever arms a1 and b1. FIG. 2 illustrates a situation in which the lever arm b1 has been reduced to zero, and the lever arm a1 is shorter than in FIG. 1. The contact force $F_{contact}$ on the moving contact piece 3 is less than in the situation illustrated in FIG. 1.

Figure 7:
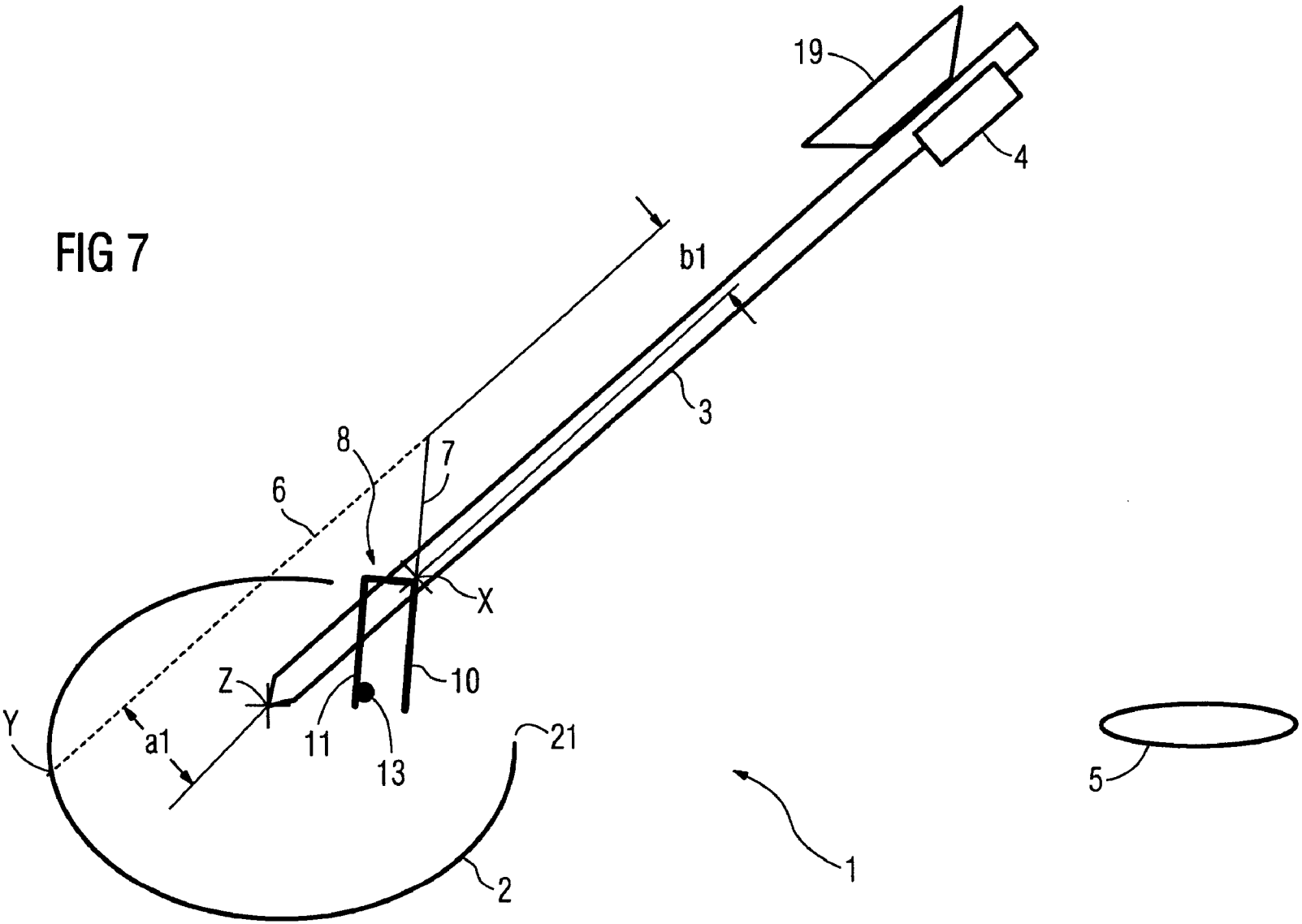
Figure 14:
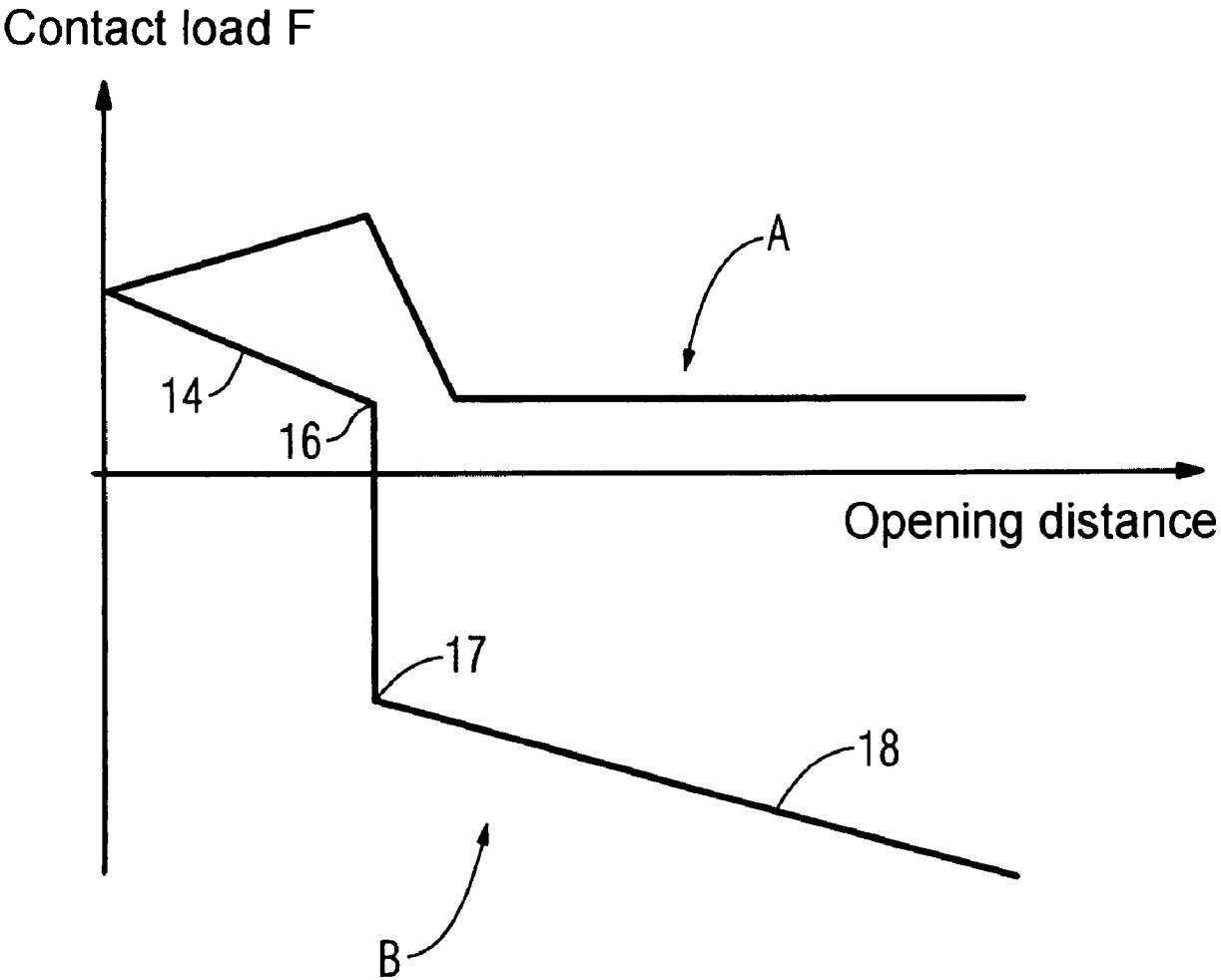
FIG. 14 shows a comparison of a contact load characteristic of a conventional switching device with a contact load characteristic of a switching device according to at least one embodiment of the invention.

In FIG. 14, which illustrates the profile of a contact load characteristic B according to at least one embodiment of the invention in addition to a contact load characteristic A of a conventional switching device, this situation is characterized by the first subsection 14 of the contact load characteristic B. FIG. 14 illustrates the profile of the contact load characteristic of the contact-making position illustrated in FIG. 1, as far as the opening position shown in FIG. 7.

Figure 3:
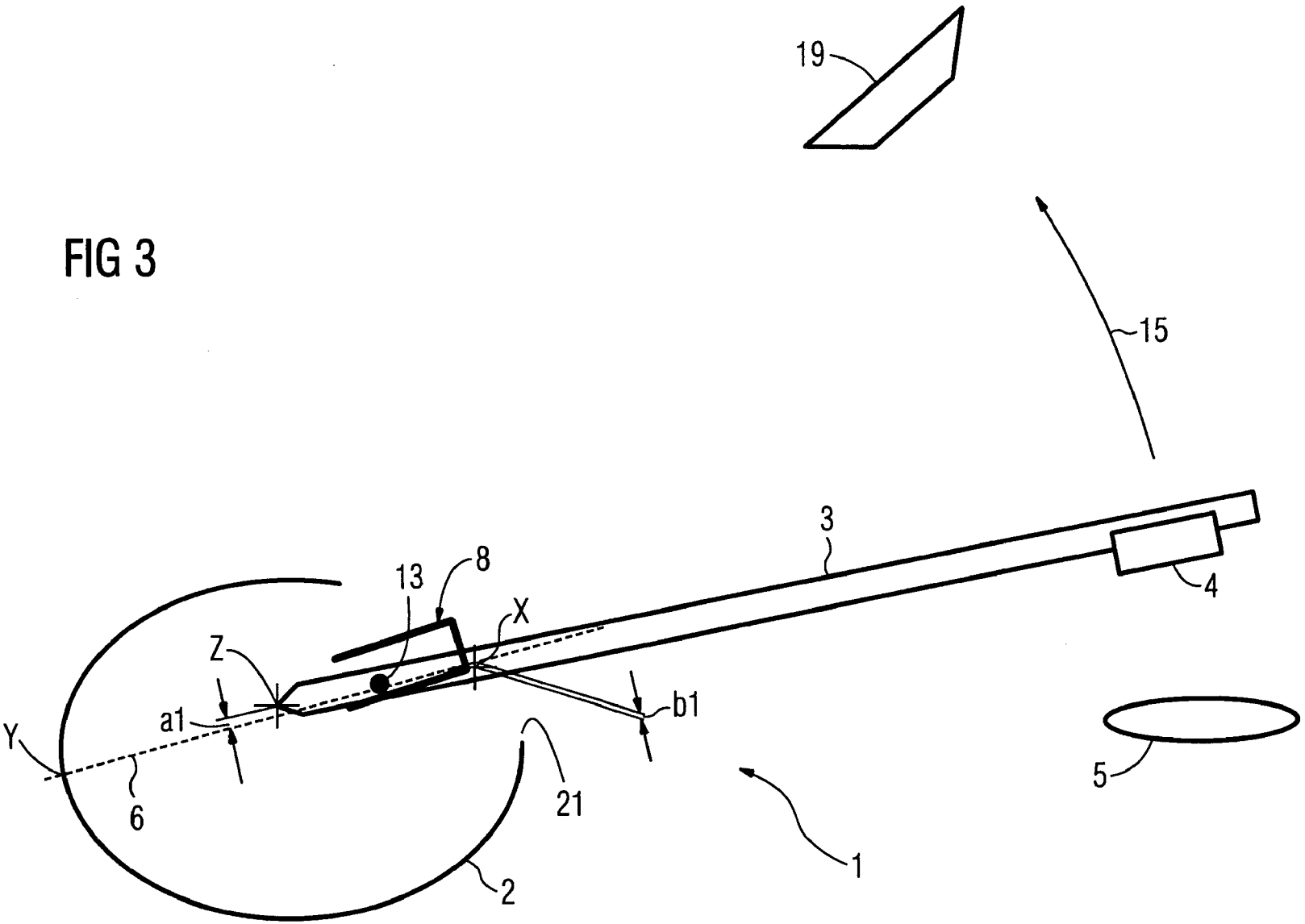

FIG. 3 shows a position from the further profile of the opening of the contact. In this case, the lever arm b1 has already become negative. The lever arm a1 has been further reduced, so that the contact load is decreased further.

Figure 4:
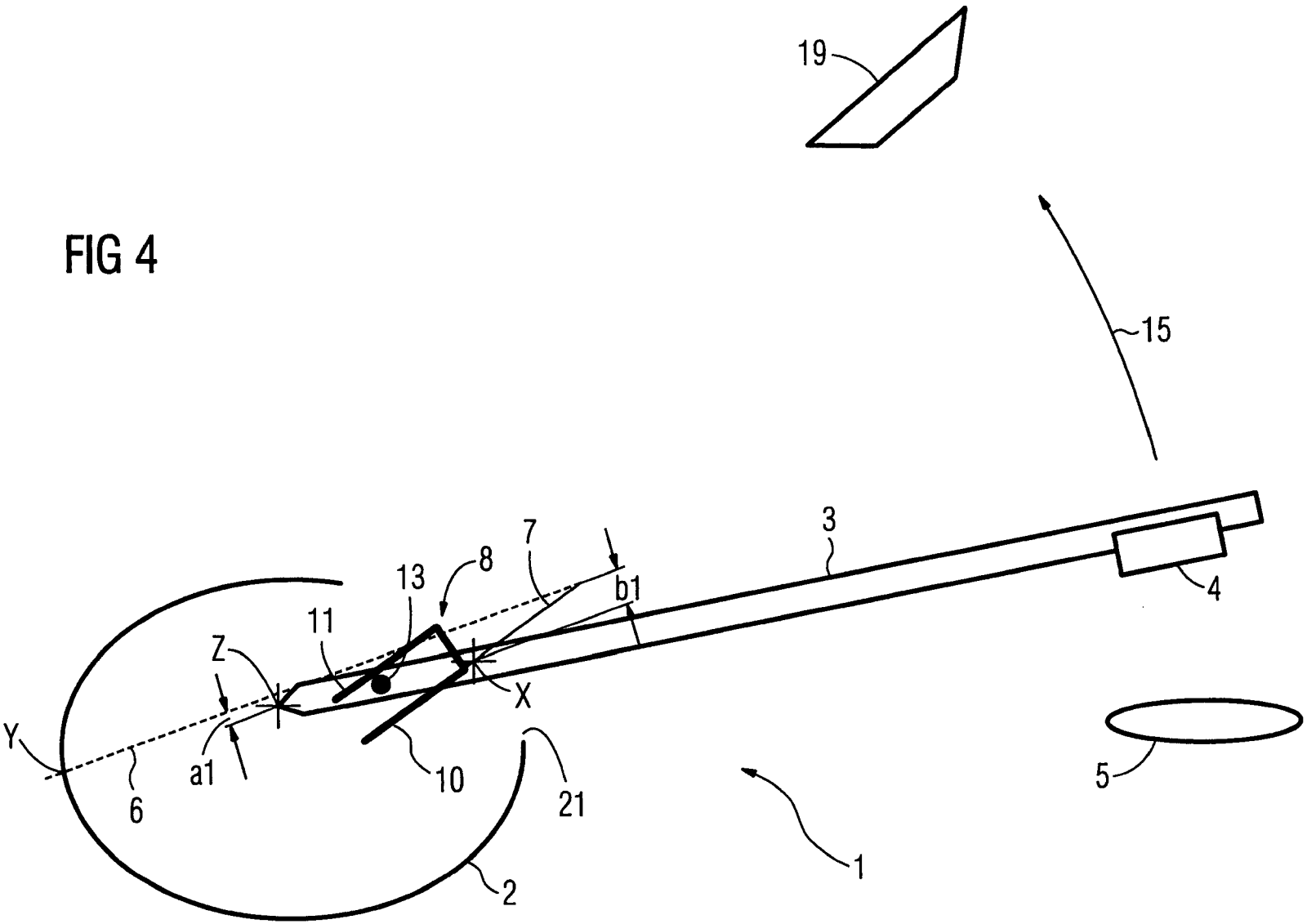

Finally, FIG. 4 shows a situation in which the claw 8 has snapped over suddenly from its inner U-limb 10 on to its outer U-limb 11. Prior to this, the moving contact piece 3 had moved ever further in the opening direction 15 until the inner U-limb 10 or the extended limb 7 of the claw 8 was located precisely on the force line of action 6. Owing to the intrinsic dynamics of the system, the moving contact piece 3 does not, however, remain in this unstable position. In fact, the contact piece 3 continues to move until the force line of action 6 has moved beyond the rotation point X. As soon as the friction that occurs in this case in the dead-point joint, inter alia, has been overcome, the claw 8 snaps over and the lever arm b1 becomes negative. In other words, the claw 8 snaps over when the friction circle is overcome at the point X, which occurs even before the force line of action 8 enters the friction circle of the rotation point Z.

The time of snapping over thus depends on the friction circle of the dead-point joint, that is to say on the roughness of its surface and on the friction associated with this. The rougher the surface of the joint, the larger is the friction circle and the later the claw 8 in consequence snaps over. At the joint dead-point, the force line of action 6 passes through the center point of the joint. The claw 8 does not snap over until the friction circle has been exceeded.

After snapping over, the outer U-limb 11 rests on the supporting element 13. In this case, the claw 8 has a sufficient amount of play that the force line of action 6 changes its position without any problems beyond the rotation point Z. In consequence, the force $F_{contact}$ on the moving contact piece 3 becomes negative, since the lever arm a1 is likewise negative. Thus, from this time, the contact is open completely without any electrodynamic drive, just with the aid of the spring element.

In contrast to conventional switches, in which the contact load becomes ever greater as the contact force of the contact piece increases so that the moving contact piece frequently falls back to its contact position again, this results in rapid and reliable opening as far as the open position. In FIG. 14, the situation identified by FIG. 3 is characterized by the point 16, at which the contact load characteristic B is vertical and becomes negative. The situation illustrated in FIG. 4 is symbolized by the point 17 in FIG. 14. After this time, the contact load decreases continuously, as can be seen from the falling subsection 18 of the contact load characteristic B.

Figure 5:
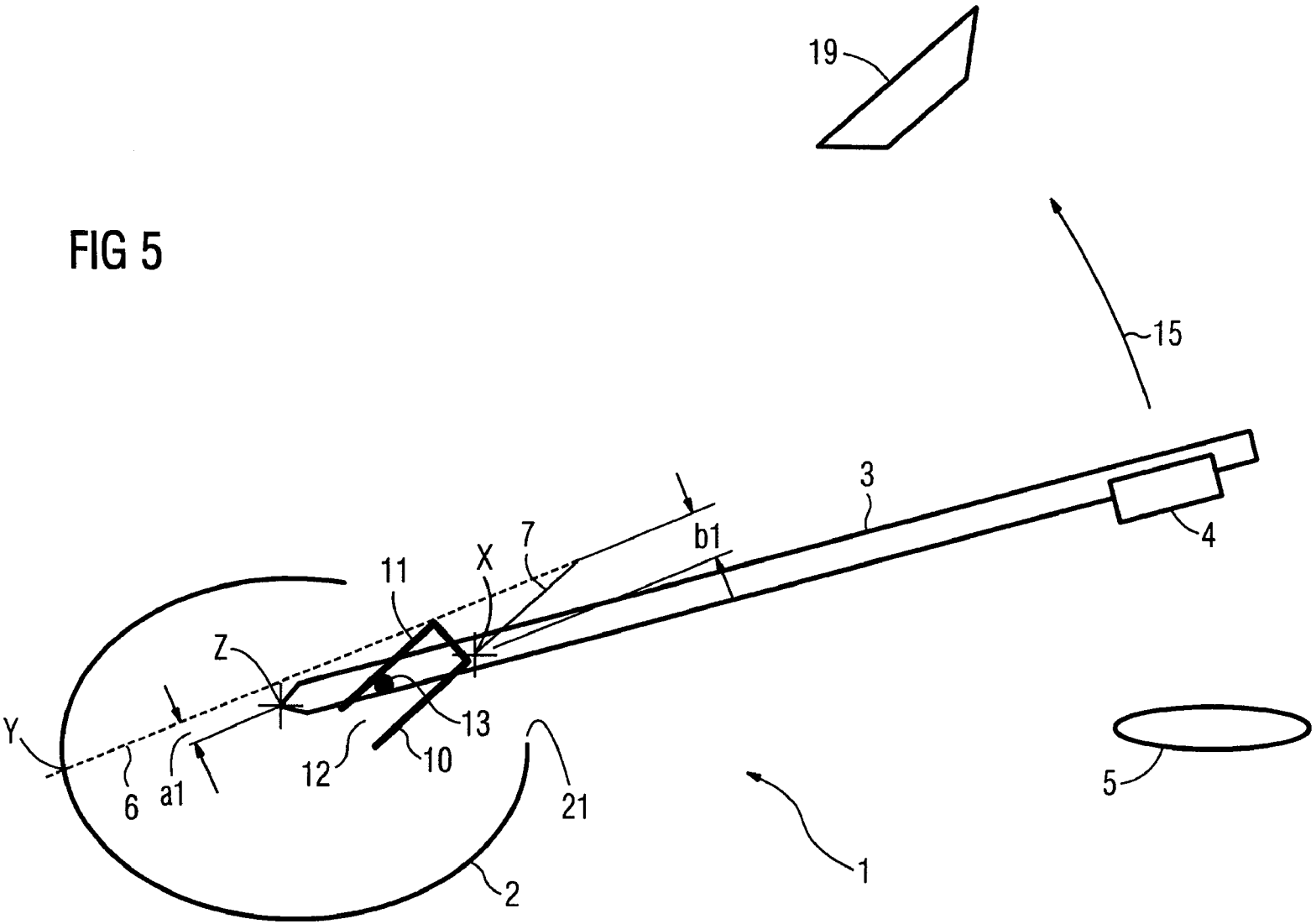
Figure 6:
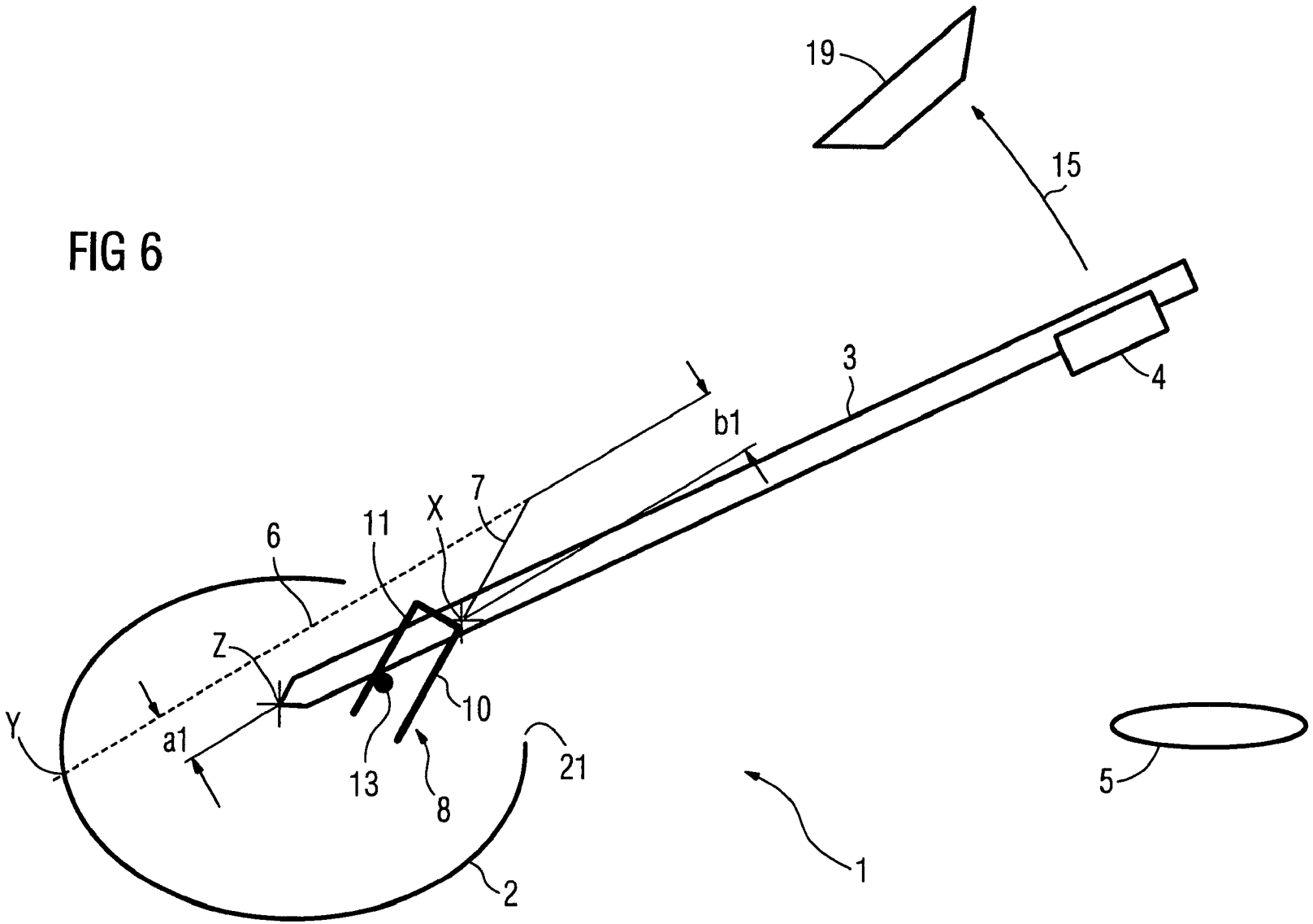

FIGS. 5 and 6 show the rest of the profile of the opening movement, with the lever arm a1 becoming continuously greater. In the situation illustrated in FIG. 7, the moving contact piece 3 has made contact with a stop 19. The switching shaft 2 is still in its original position. The lever arm a1 is still negative.

Figure 8:
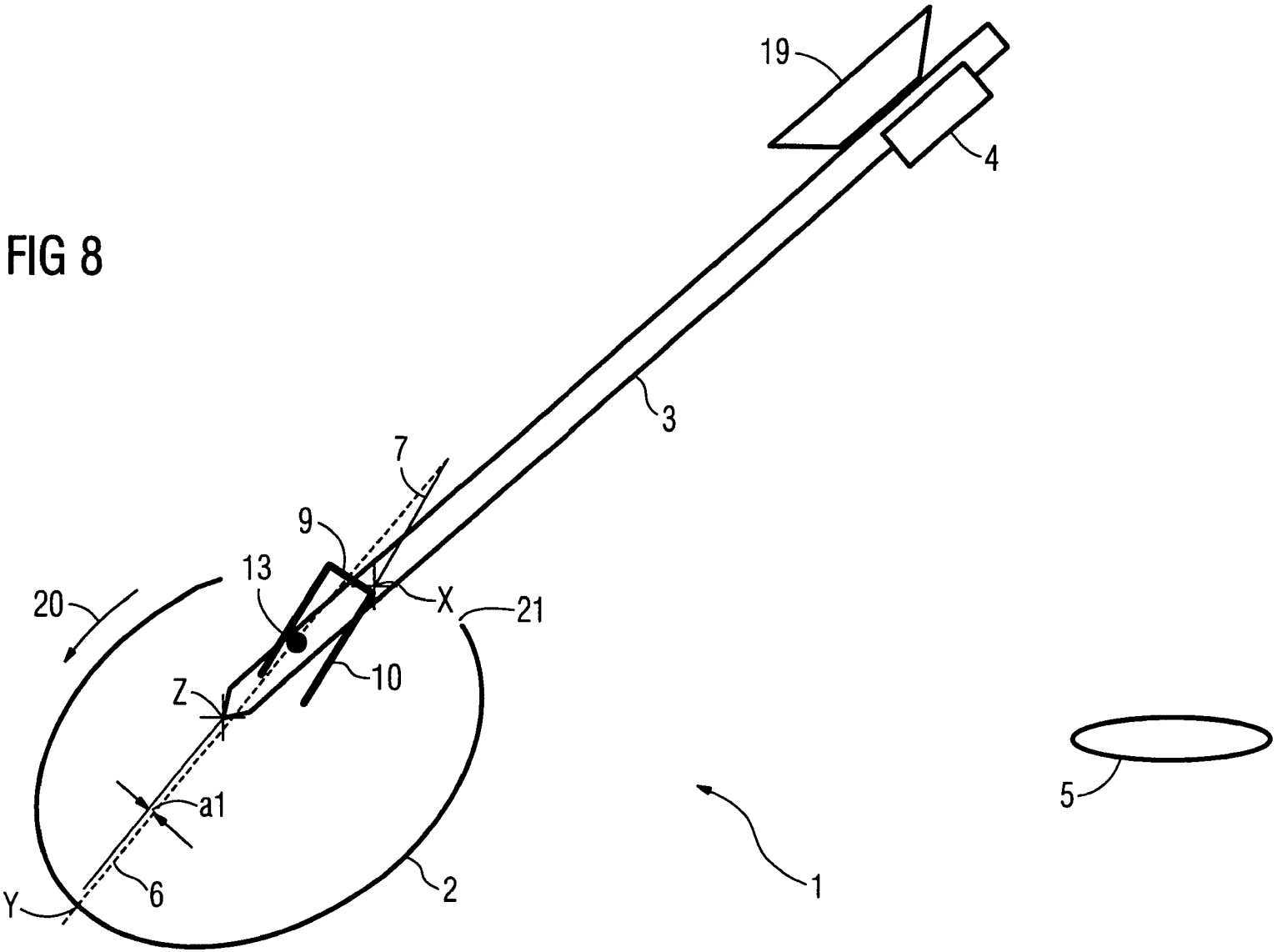

In the meantime, the switching mechanism has been released by an electromagnetic release (not shown). The switching shaft 2 is rotated counterclockwise in the direction of its OFF position. In other words, the regular opening of the contact now takes place. The rotation of the switching shaft 2 in the OFF direction 20 also results in opening of the contacts of the two other phases, in which no short circuit or overcurrent has occurred, see FIG. 8. The switching shaft 2 rotates until the force line of action 6 passes over the rotation point Z again. In other words, the lever arm a1 is once again positive in this case. This is necessary in order that the switching device 1 can be closed.

Figure 9:
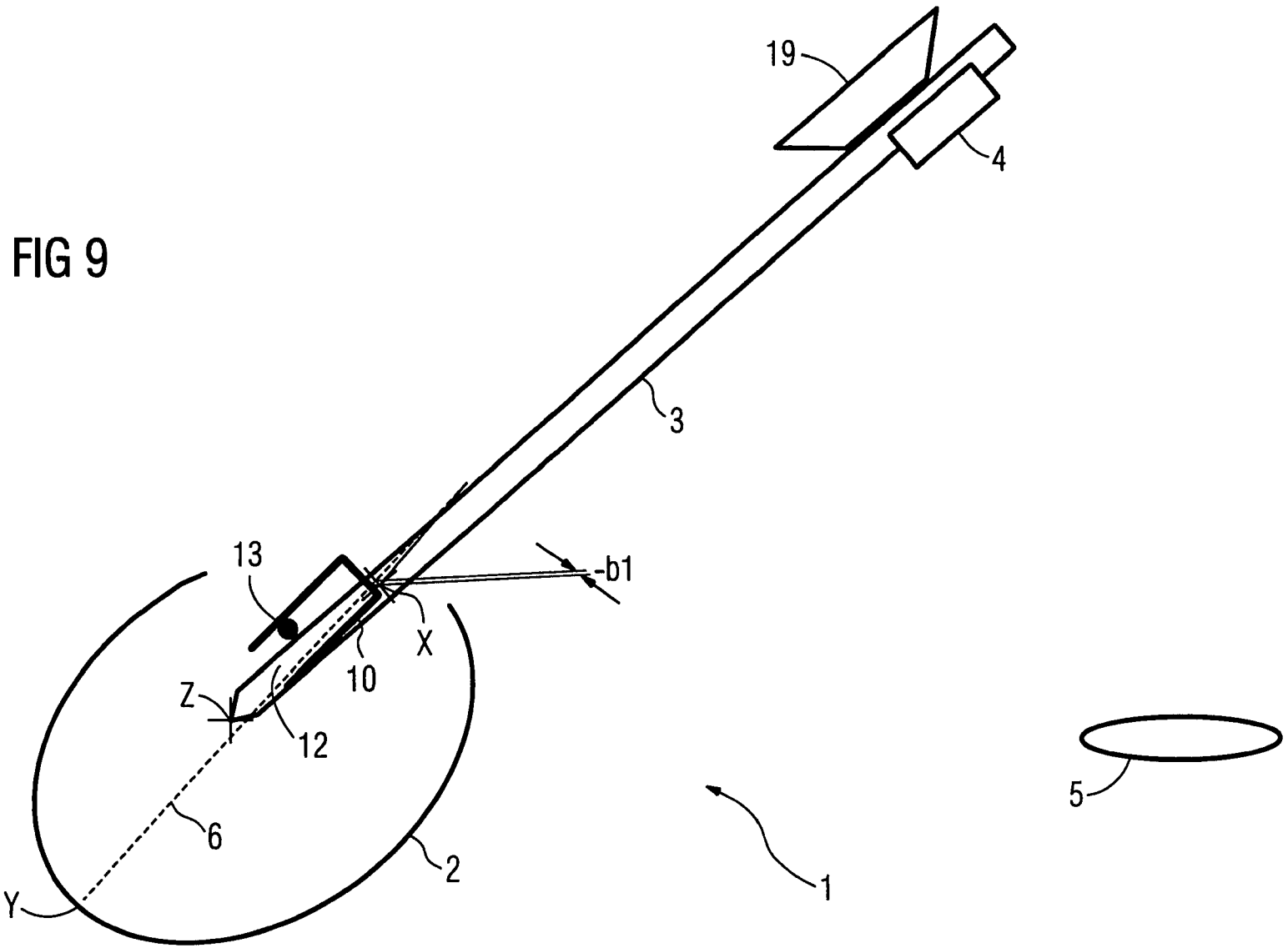
Figure 10:
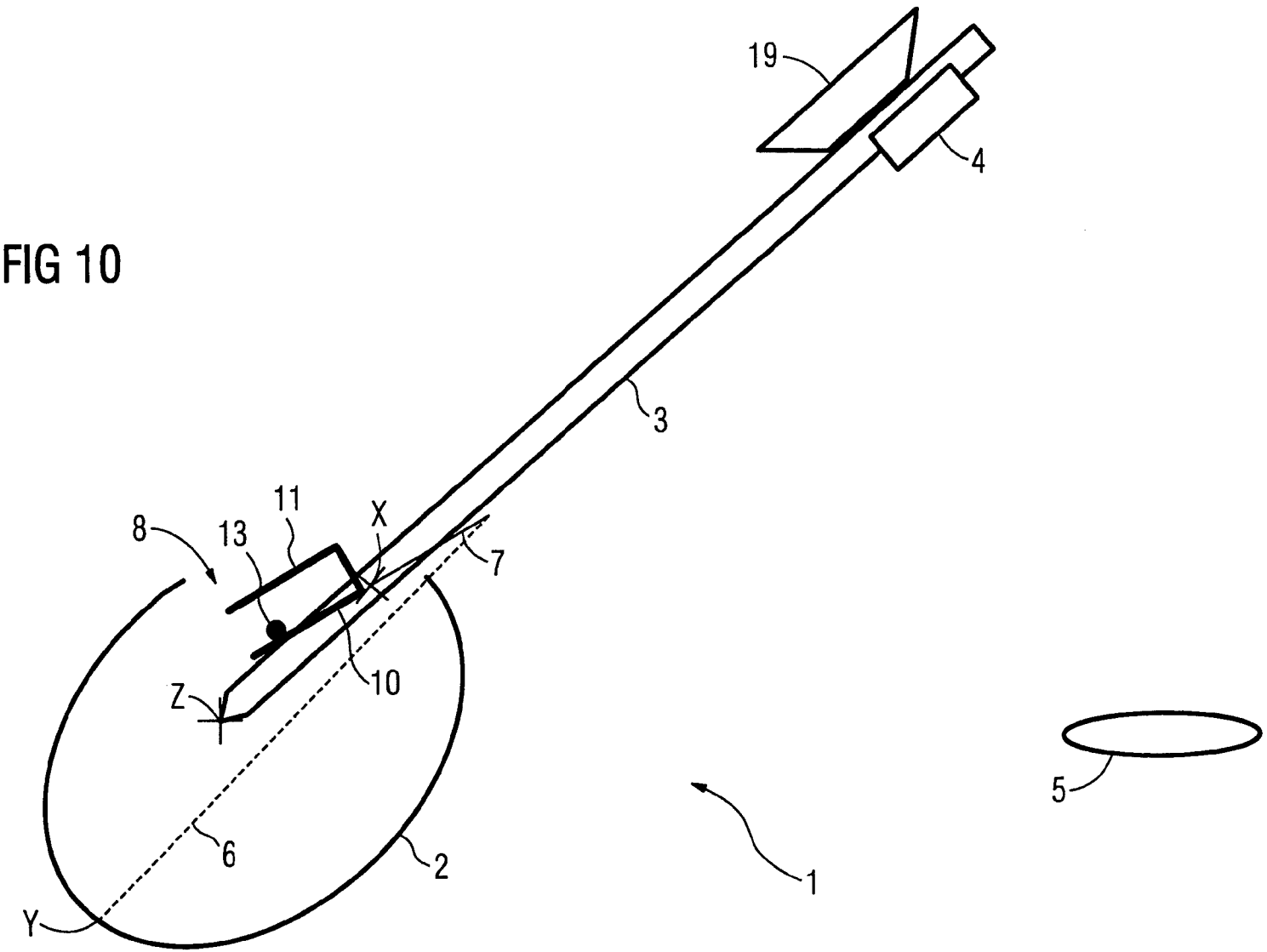

FIGS. 9 and 10 show further positions of the switching device 1 during the opening process. In this case, the lever arm b1 is still negative in FIG. 9, while it has already become positive in FIG. 10. In this case, the claw 8 has already snapped over again, so that it is once again supported by its inner U-limb 10 on the supporting element 13. These changes are produced exclusively by the movement of the switching shaft 2.

Figure 11:
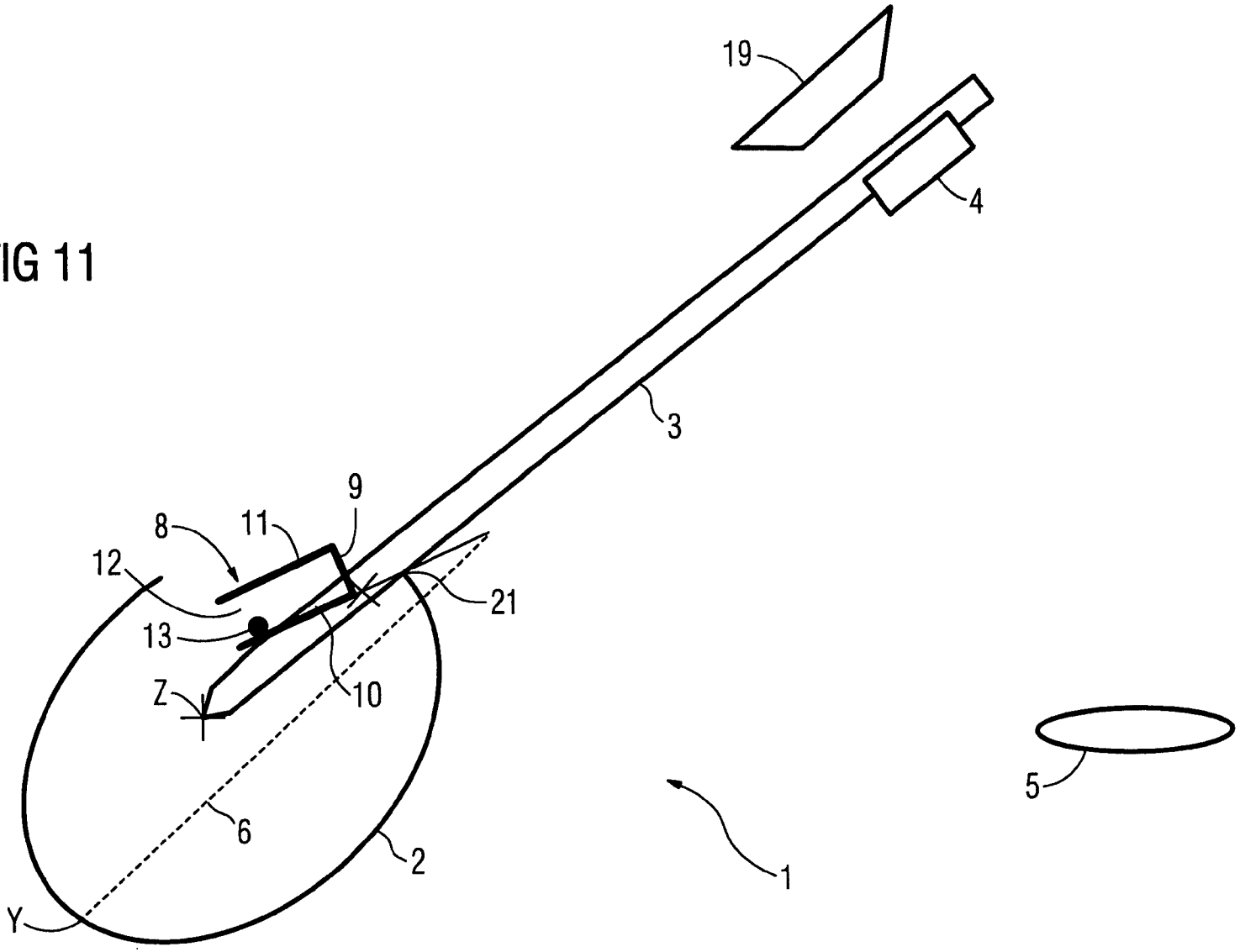
Figure 12:
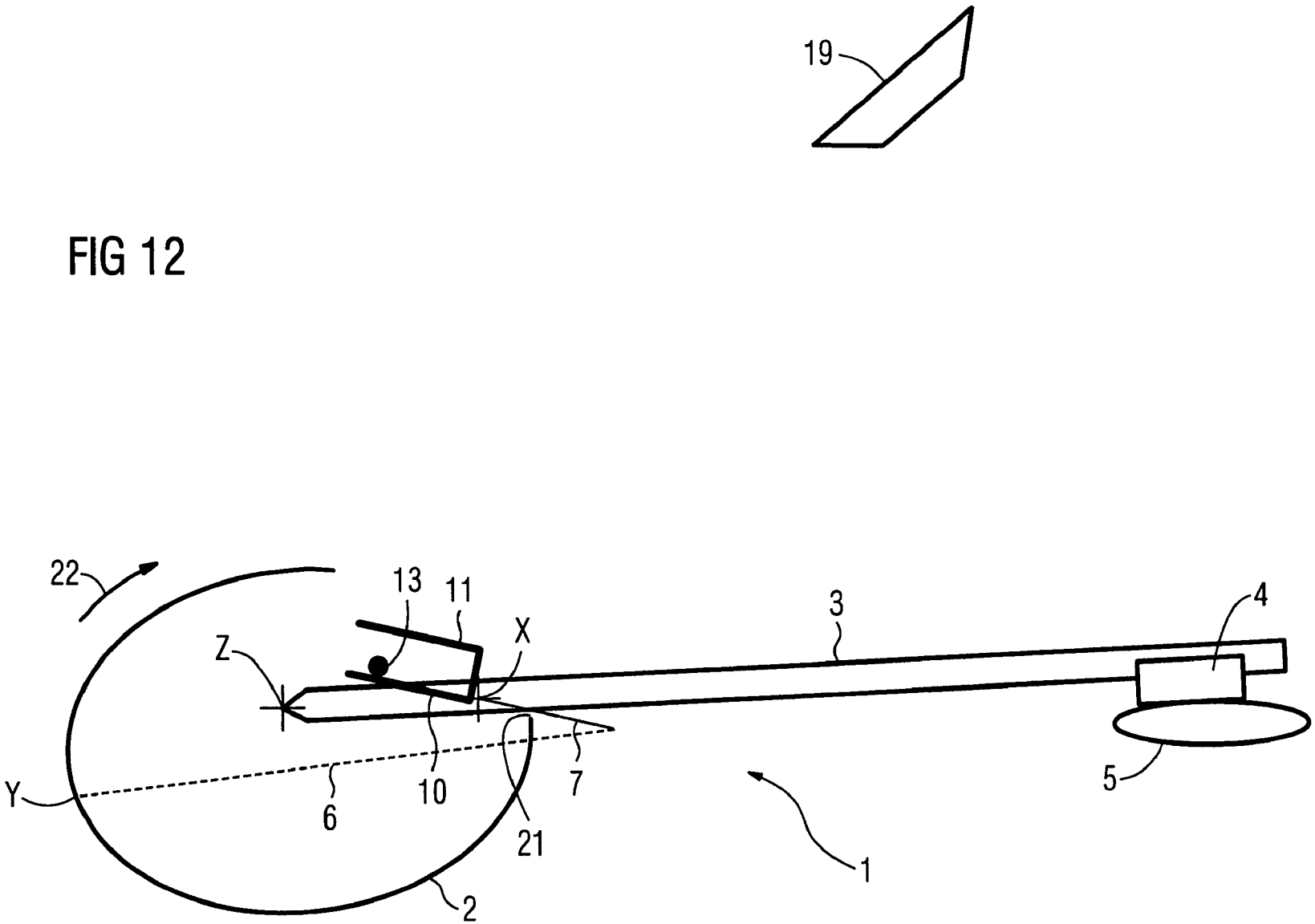

In FIG. 11, both lever arms a1 and b1 are positive again, so that the moving contact piece 3 can once again be moved in the direction of the fixed contact piece 5. During this movement, the moving contact piece 3 strikes against a stop 21 in the switching shaft 2. The stop 21 is in this case preferably in the form of an opening in the switching shaft 2.

The switching shaft 2 and the moving contact piece 3 then move jointly in the direction of the contact position, until the fixed contact piece 5 is reached once again. At this time, there is still no force acting on the fixed contact piece 5, since the moving contact piece 3 is still supported on the stop 21.

Figure 13:
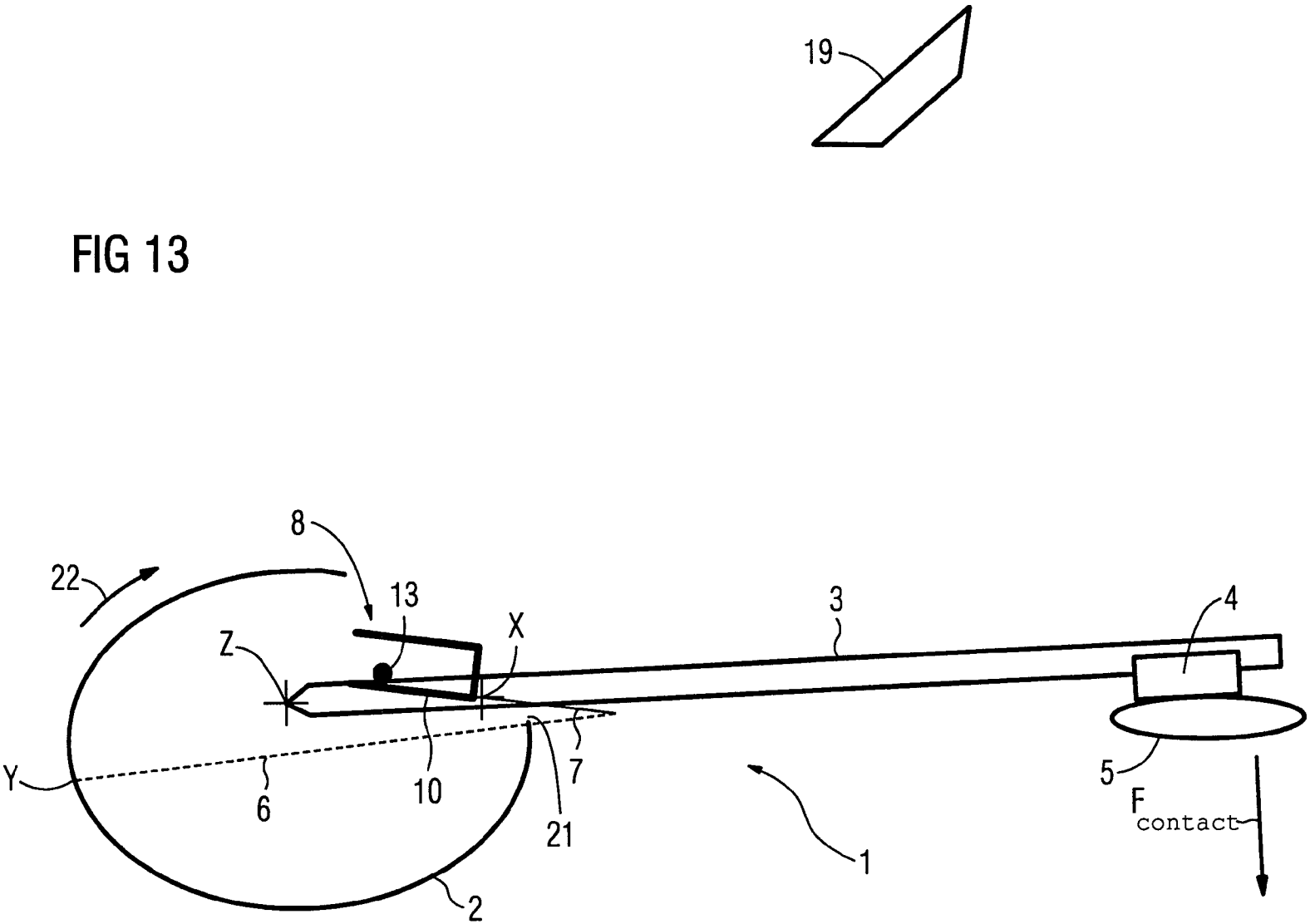

When the switching shaft 2 is rotated further in the ON direction 22, as shown in FIG. 13, the moving contact piece 3 remains in the position that it has reached. In other words, the moving contact piece 3 is then lifted off the stop 21 in the switching shaft 2. A contact force $F_{contact}$ once again acts on the fixed contact piece 5, corresponding to the lever effects which have already been described above, see FIG. 1.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electrical switching device, comprising:

a switching shaft;

a moving contact piece, operateable by the switching shaft; and a snap-action system which interacts with the moving contact piece such that the moving contact piece is automatically moved to a switched-off position after contact opening by electrodynamic forces in the event of a short circuit, in such a way that, as the opening increases, a contact load on the moving contact piece decreases, wherein the snap-action system is mounted on the moving contact piece with a dead-point joint being formed, and the moving contact piece is mounted on the switching shaft with a dead-point joint being formed.

2. The electrical switching device as claimed in claim 1, wherein the dead-point joints are arranged such that the line of action of a spring element which acts on the snap-action system never passes through the two rubbing circles of the dead-point joints at the same time.

3. An electrical switching device, comprising:

a snap-action system, to interact, in the event of a short circuit, with a moving contact piece of the device such that the moving contact piece is automatically moved to a switched-off position after contact opening by electrodynamic forces such that as the opening increases, a contact load on the moving contact piece decreases, wherein the snap-action system is mounted on the moving contact piece with a dead-point joint being formed, and the moving contact piece is mounted on a switching shaft of the device with a dead-point joint being formed.

4. The electrical switching device as claimed in claim 3, wherein the dead-point joints are arranged such that the line of action of a spring element which acts on the snap-action system never passes through the two rubbing circles of the dead-point joints at the same time.

5. An electrical switching device, comprising:

a moving contact piece; and snap-action means for interacting, in the event of a short circuit, with the moving contact piece such that the moving contact piece is automatically moved to a switched-off position after contact opening by electrodynamic forces such that as the opening increases, a contact load on the moving contact piece decreases, wherein the snap-action means is mounted on the moving contact piece with a dead-point joint being formed, and the moving contact piece is mounted on a switching shaft of the device with a dead-point joint being formed.

6. The electrical switching device as claimed in claim 5 wherein the dead-point joints are arranged such that the line of action of a spring element which acts on the snap-action system never passes through the two rubbing circles of the dead-point joints at the same time.

* * * * *